United States Patent [19]

Pasini, III et al.

[11] 4,062,404

[45] Dec. 13, 1977

[54] METHOD FOR IN SITU COMBUSTION

[75] Inventors: Joseph Pasini, III; Lowell Z. Shuck; William K. Overbey, Jr., all of Morgantown, W. Va.

[73] Assignee: The United States of America as represented by the United States Energy Research and Development Administration, Washington, D.C.

[21] Appl. No.: 728,358

[22] Filed: Sept. 30, 1976

[51] Int. Cl.[2] ..... E21B 43/24; E21B 43/26

[52] U.S. Cl. ..... 166/259; 166/50; 166/52; 166/251

[58] Field of Search ..... 166/259, 251, 256, 245, 166/50, 52, 272

[56] References Cited

U.S. PATENT DOCUMENTS

| | | | |
|---|---|---|---|
| 2,390,770 | 12/1945 | Barton et al. | 166/251 |
| 2,786,660 | 3/1957 | Alleman | 166/50 X |
| 3,205,942 | 9/1965 | Sandberg | 166/251 X |
| 3,228,468 | 1/1966 | Nichols | 166/259 |
| 3,434,541 | 3/1969 | Cook et al. | 166/256 |
| 3,775,073 | 11/1973 | Rhoades | 166/259 X |
| 3,933,447 | 1/1976 | Pasini et al. | 166/259 X |
| 3,960,213 | 6/1976 | Striegler et al. | 166/50 X |
| 3,990,514 | 11/1976 | Krenin et al. | 166/259 |
| 3,997,005 | 12/1976 | Komar | 166/251 |

*Primary Examiner*—Stephen J. Novosad

*Attorney, Agent, or Firm*—Dean E. Carlson; Stephen D. Hamel; Earl L. Larcher

[57] ABSTRACT

This invention relates to an improved in situ combustion method for the recovery of hydrocarbons from subterranean earth formations containing carbonaceous material. The method is practiced by penetrating the subterranean earth formation with a borehole projecting into the coal bed along a horizontal plane and extending along a plane disposed perpendicular to the plane of maximum permeability. The subterranean earth formation is also penetrated with a plurality of spaced-apart vertical boreholes disposed along a plane spaced from and generally parallel to that of the horizontal borehole. Fractures are then induced at each of the vertical boreholes which project from the vertical boreholes along the plane of maximum permeability and intersect the horizontal borehole. The combustion is initiated at the horizontal borehole and the products of combustion and fluids displaced from the earth formation by the combustion are removed from the subterranean earth formation via the vertical boreholes. Each of the vertical boreholes are, in turn, provided with suitable flow controls for regulating the flow of fluid from the combustion zone and the earth formation so as to control the configuration and rate of propagation of the combustion zone. The fractures provide a positive communication with the combustion zone so as to facilitate the removal of the products resulting from the combustion of the carbonaceous material.

4 Claims, 3 Drawing Figures

METHOD FOR IN SITU COMBUSTION

The present invention relates generally to the recovery of hydrocarbons from subterranean earth formations and, more particularly, to an improved method of in situ combustion of such formations wherein the combustion zone propagates through the earth formations at selectively controlled rates and configurations.

The recovery of hydrocarbons from underground strata containing carbonaceous material by in situ combustion processes is becoming of increasing importance in the effort to satisfy the energy needs of the world. The in situ combustion is initiated in the carbonaceous material and the resulting combustion zone is caused to move through the stratum by either a reverse or direct burn. The heat of combustion gasifies the carbonaceous material to provide gaseous hydrocarbons and also displaces hydrocarbon material from the stratum so as to provide a recoverable source of fluid (gas and liquid) which contains considerable energy values. Several variables are associated with in situ combustion processes which determine operating parameters. For example, in a conventional forward or reverse burn in situ combustion process the underground stratum is penetrated by boreholes set at spaced-apart locations with the spacing being determined by such factors as the allowable air (combustion supporting medium), injection pressure, the air velocity in the stratum, the permeability of the underground earth formation containing the carbonaceous material, and the particular type of earth formation containing the recoverable hydrocarbons. Such in situ combustion techniques as presently known may be used to recover hydrocarbons in the form of fluids, such as petroleum from tar sands, oil sands, and shale, and high and low Btu gases from subterranean coal beds.

In the recovery of liquid hydrocarbon products by employing conventional forward burn in situ combustion operations the combustion zone propagates from a point near the face of an air injection well towards a production well so as to displace the viscous hydrocarbons towards the production well where the product is recovered. However, there has been found to be several problems attendant with the use of in situ combustion for this purpose. For example, the liquid hydrocarbon is of a relatively low viscosity near the combustion zone but substantially increases in viscosity as it cools and nears the production well so as to present considerable difficulty in displacing the liquid through the underground strata for subsequent removal at the production well. In fact, the resistance to flow of the liquid hydrocarbons through the reservoir eventually becomes so great that the combustion process becomes somewhat restricted due to the lack of a suitable discharge for the combustion products.

In the recovery of gaseous hydrocarbons from subterranean coal beds by the gasification of the coal the products of the forward burn combustion process flow through the coal bed to the producer well where the gaseous product is withdrawn. The control of the combustion zone with respect to its configuration and rate of propagation through the subterranean coal bed presents some problems in that these operating parameters must be carefully controlled so as to maintain the Btu content of the gas at an acceptably high level and also insure that the combustion zone advances through the coal bed in such a manner that essentially all available coal lying between the injection well and the producer well is gasified. Frequently, the combustion zone propagates between the injection well and the producer well along an irregular and uncontrolled path such that the burn front of the combustion zone reaches the producer well without contacting a substantial quantity of the coal lying therebetween. This problem due to irregular and uncontrolled combustion zone propagation considerably detracts from the overall efficiency and desirability of the in situ combustion processes. These problems due to lack of control over the combustion zone configuration and rate of propagation are also present in in situ combustion processes used for the recovery of liquid hydrocarbons from earth strata containing burnable and displaceable carbonaceous material such as mentioned above.

Several efforts have been previously made to insure that essentially all the coal or other carbonaceous material lying between the injector well and the producer well is subjected to the combustion process so as to efficiently recover the hydrocarbons in the carbonaceous material. One such effort is disclosed in assignee's U.S. Pat. No. 3,933,447 which issued Jan. 20, 1976, and is entitled "Underground Gasification Of Coal" by Joseph Pasini III et al. This patent teaches that efficient gasification of an underground coal bed may be achieved by penetrating the coal bed with spaced-apart directionally drilled boreholes which project along a horizontal plane within the coal bed that extends in a direction normal to the plane of maximum permeability. The combustion of the coal is initiated at one of these horizontal boreholes and the product gas is removed from the producer borehole which spaced the combustion along the plane of maximum permeability. The combustion process in this patent is enhanced by utilizing the natural fracture system extending between the injection borehole and the producer borehole to assure the propagation of the combustion zone therebetween as well as to enhance the removal of the product gas. It is further contemplated in this patent to induce fractures in the coal bed extending between the boreholes so as to further enhance the removal of the product gas and increase the efficiency of the combustion operation.

While the combustion process described in assignee's aforementioned patent represents a substantial advancement in the field, there were still several factors present which detracted from the overall efficiency of the process. For example, the presence of non-uniform permeability in the coal bed lying between the injector borehole and the producer borehole due to such conditions as excessive natural fractures or other anomalies in a portion of the coal bed or the non-uniformity of the induced fractures could cause the combustion zone to propagate at an excessive rate in that portion of the coal bed. Further, in the event such non-uniform propagation of the combustion zone occurred in one portion of the coal bed there was no mechanism for controlling the combustion zone configuration such as by slowing the rate of propagation in this portion of the coal bed or by increasing the burn rate in other portions of the coal bed so as to provide a more uniform and efficient gasification process.

Accordingly, it is the primary aim or goal of the present invention to provide an in situ combustion process for recovering hydrocarbons from a subsurface strata containing carbonaceous material that represents an improvement over the process described in the aforementioned patent as well as other processes known in the art. Generally, the subject in situ combustion process is practiced by the steps of penetrating the earth formation with at least one borehole projecting into the earth formation along a substantially horizontal plane with respect to the earth surface and along a plane substantially perpendicular to the plane of maximum permeability in the earth formation. Penetrating the earth formation with a plurality of vertically extending boreholes with these boreholes spaced apart from one another along a plane substantially parallel to the horizontal borehole. Providing an induced fracture in the earth formation at each of the plurality of vertical boreholes along a plane substantially parallel to the plane of maximum permeability and intersecting with the horizontal borehole for establishing a plurality of fluid flow paths which extend between the horizontal borehole and the plurality of vertical boreholes. Combustion is initiated in the carbonaceous material adjacent to the horizontal borehole to form a combustion zone. Hydrocarbon-containing fluid resulting from or displaced by the combustion of the carbonaceous material is withdrawn through the plurality of vertical boreholes primarily via the fluid flow paths provided by the fractures with the rate of flow of the fluid through each of the plurality of vertical boreholes being controlled for selectively controlling the configuration and rate of propagation of the combustion zone. By practicing the method of the present invention, the necessary controls are provided over the combustion zone configuration and rate of propagation to insure that, if desired, all portions of the carbonaceous material lying between the horizontal borehole and the vertical boreholes may be subjected to combustion. Further, the presence of the induced fractures extending from the combustion zone to the flow-controlled vertical boreholes provides a conduit for efficiently conveying both liquid and gaseous hydrocarbons to points of recovery, i.e., the vertical boreholes.

Other and further objects of the invention will be obvious upon an understanding of the illustrative method about to be described or will be indicated in the appended claims, and various advantages not referred to herein will occur to one skilled in the art upon employment of the invention to practice.

An embodiment of the invention has been chosen for the purpose of illustration and description of the method disclosed and claimed herein. The embodiment illustrated is not intended to be exhaustive or to limit the invention to the precise method steps disclosed. It is chosen and described in order to best explain the principles of the invention and their application in practical use to thereby enable others skilled in the art to best utilize the invention in various embodiments and modifications of the method as are best adapted to the particular use contemplated.

Figure 1:
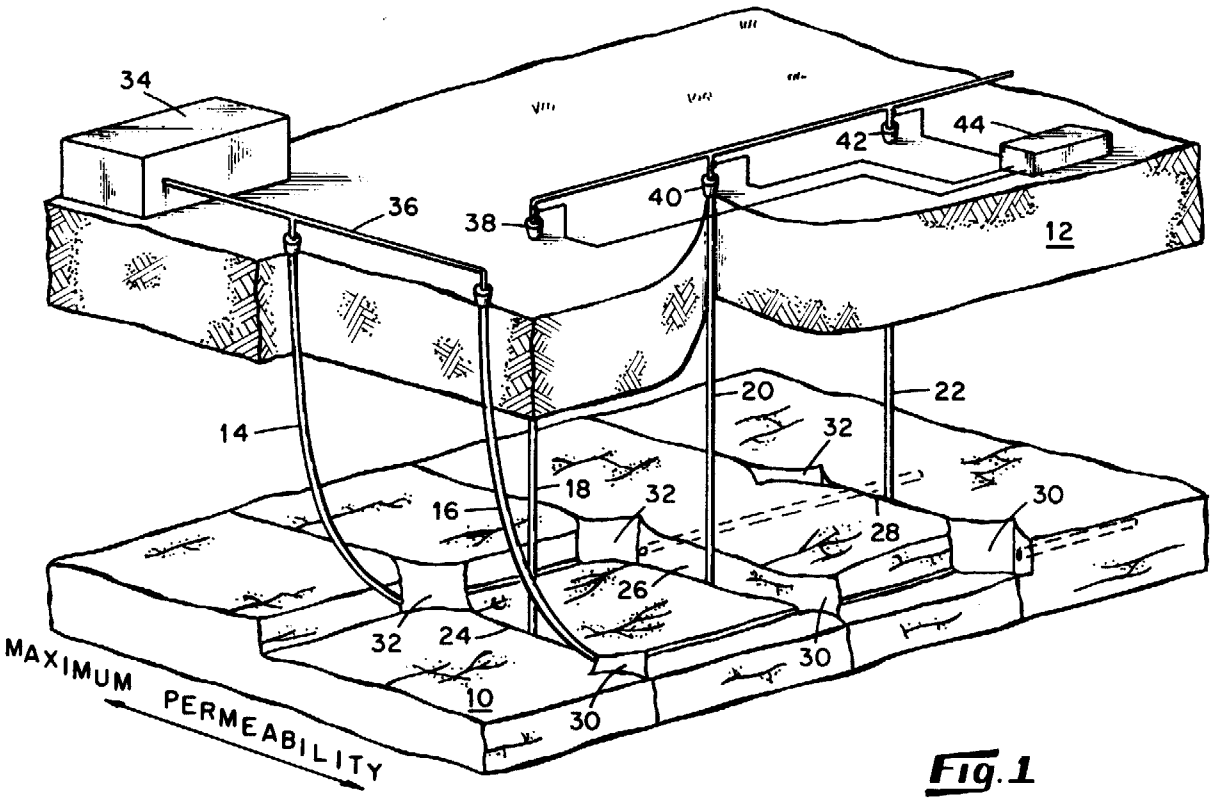
FIG. 1 is a schematic perspective view showing a subsurface earth formation containing carbonaceous material which is provided with the borehole and fracture system in accordance with the practice of the subject method.
Figure 2:
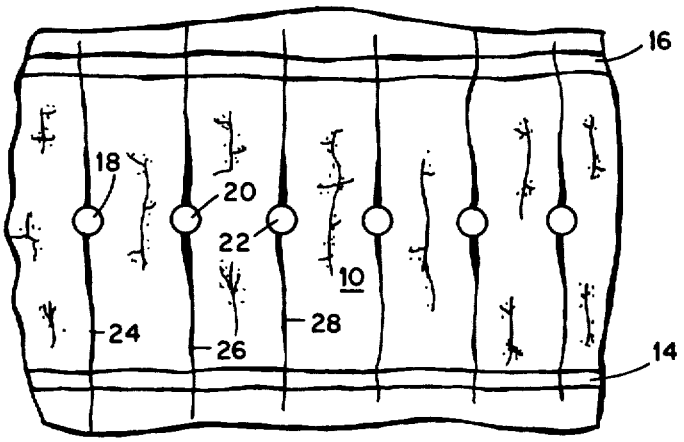
FIG. 2 is a schematic plan view showing the borehole and fracture orientation of the FIG. 1 embodiment with a greater number of vertical boreholes prior to combustion.
Figure 3:
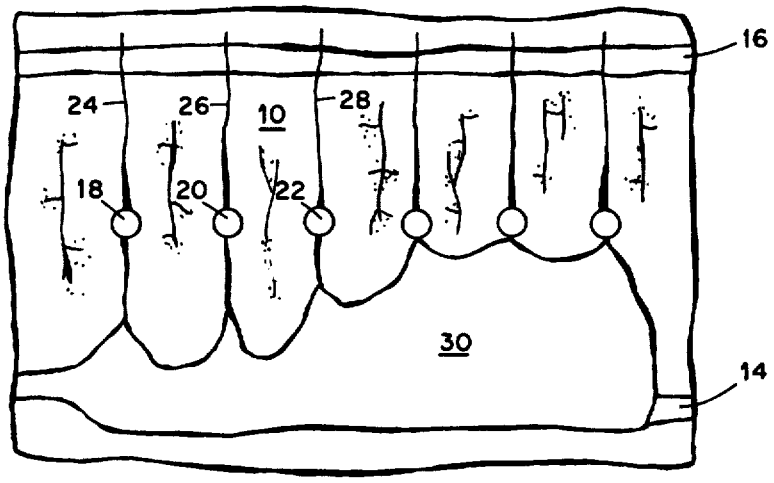
FIG. 3 is a schematic plan view similar to FIG. 2, but showing various schemes of controlled combustion which may be achieved by practicing the subject method.

With reference to FIGS. 1-3 of the accompanying drawings, the method of the present invention for recovering hydrocarbons from subsurface earth formations containing carbonaceous material by employing in situ combustion procedures may be practiced by employing the illustrated drilling and fracturing scheme. As shown in FIG. 1, subterranean earth formation 10 containing carbonaceous material is disposed at some level below one or more layers of overburden 12. A directional borehole 14 is drilled from the surface of the overburden 12 on a slant so as to penetrate the subterranean strata containing the carbonaceous material along a substantially horizontally oriented path with respect to the subterranean strata 10 or the surface of the overburden 12. The borehole 14 is drilled in this horizontal direction and perpendicular to the plane of maximum permeability in the strata 10 either continuously from the surface through the strata 10 and back to the surface or into the strata 10 and terminating at some location therein. The drilling of the borehole 14 to provide the horizontal orientation of the latter within the subterranean earth strata 10 may be initiated at any angle from vertical at the surface with this angle depending upon the depth of the coal bed and the type of the drilling equipment employed. In any event, the drilling procedure should be such that when the borehole 14 enters the carbonaceous strata 10 it is traveling in a substantially horizontal direction so as to penetrate a desired portion of the subterranean earth formation strata 10. The use of such a horizontal borehole substantially minimizes the number of well bores necessary to contact a relatively large segment of the subsurface earth strata 10. Further details relating to the drilling of the horizontal borehole 14 are set forth in the aforementioned patent. Borehole 14 extends horizontally within the subsurface earth strata along a plane oriented substantially perpendicular to the plane of maximum permeability which is also substantially perpendicular to the plane of maximum tetonic compressive stress. Preferably, the subterranean earth formation is penetrated with one or more additional horizontal boreholes similar to borehole 14, such as shown at 16, with these horizontal boreholes being parallel to and separated from one another a selected distance in the range of about 200 to 1000 feet depending upon the particular characteristics of the subterranean strata 10. With boreholes 14 and 16 projecting through the strata 10 along a plane perpendicular to the plane of maximum permeability, the maximum fluid flow through the strata is along planes extending between these boreholes 14 and 16.

In accordance with the practice of the present invention a plurality of vertically extending boreholes are drilled into the subsurface earth strata 10 at locations spaced from a single horizontal borehole such as 14 or intermediate a plurality of such boreholes as 14 and 16. These vertical boreholes, as shown at 18, 20 and 22, penetrate the subsurface earth strata 10 and are spaced from one another along a plane generally parallel to that of the boreholes 14 and 16. The spacing of the vertical boreholes 18, 20 and 22 from each other and the boreholes 14 and 16 is largely dependent upon the particular subsurface earth formation in which the boreholes penetrate and upon the type of hydrocarbon recovery operation to be employed.

After the subsurface earth strata 10 is provided with the boreholes 14, 16, 18, 20 and 22 a vertical fracture is then induced in the subsurface earth strata 10 at each vertical borehole 18, 20 and 22. These fractures may be induced in the subsurface earth strata 10 by employing any well known hydraulic, explosive, or pneumatic technique as commonly practiced in the art. Since it is known that the directional characteristics of the fracture system are dictated by the orientation or the maximum tetonic compressive stress field and since this field is at least generally parallel the plane of maximum permeability, the fractures 24, 26 and 28 induced at the well bores 18, 20 and 22, respectively, can be extended from the vertical boreholes generally along the plane of maximum permeability so as to intersect the horizontal boreholes 14 and 16 and thereby placing the latter in fluid flow registry with each of the vertical boreholes.

Upon completion of the drilling and fracturing steps, combustion may be initiated in any suitable well-known manner at either of the boreholes 14 or 16 so as to provide a combustion zone at the points where each fracture intersects therewith or, if desired, over the entire length of the boreholes 14 and 16 within the strata 10. The combustion-supporting medium, e.g., air, or oxygen-rich air, is injected into the subsurface earth strata 10 from a suitable source, such as shown at 34, through a conduit system 36 coupled to the boreholes 14 and 16. With the combustion-supporting gas entering the injection bores 14 and 16 the combustion zone or zones, as shown at 30 and 32, propagate through the subsurface earth formation in a controlled forward burn manner via the fracture system to the producer wells 18, 20 and 22.

In order to control the configuration and rate of propagation of the combustion zone, each of the vertical boreholes 18, 20 and 22 are provided with flow control valves at the wellhead thereof, such as indicated at 38, 40 and 42, respectively. These valves are selectively operable to control the rate of flow and thus the extraction of the combustion products from the combustion zone and the displaced fluids from the strata through each borehole 18, 20 and 22. This control of the flow of combustion products and other fluids from the subterranean strata 10 may be achieved by employing a suitable monitoring system, as generally shown at 44, which may be used to analyze and control the flow rate by the rate of product flow through each of the vertical boreholes and/or by the composition and viscosity of the product fluid.

By selectively controlling the flow rate of the fluids from the strata 10 due to the presence of combustion zones 30 and 32 through the producer wells 18, 20 and 22, the combustion process, the rate of burn front propagation and the configuration of the combustion zone or zones in the subterranean earth formation may be closely regulated so as to efficiently combust the entire or selected portions of the earth formation lying between the injector wells and the producer wells. Further, by employing the vertical fracture system 24, 26 and 28 between the injector wells and the producer wells, the products resulting from the combustion of the carbonaceous materials are provided with relatively open conduits for facilitating the recovery of fluids from the subterranean earth formation.

As best shown in FIG. 3, the general configuration or layout of the boreholes and the fracture system greatly facilitates the control over the combustion zone so as to assure efficient recovery of the hydrocarbons in the subterranean earth formations. For example, the particular orientation of the combustion zone can be regulated by the selective control of the valved wellheads on the vertical boreholes so that the combustion zone may uniformly propagate across the entire earth formation between the horizontal injector wells 14 or 16 to the producer wells 18, 20 and 22. Alternatively, if it is desirable to selectively combust segments or blocks of the subterranean earth formation 10, the flow through one or more of the vertical boreholes may be substantially reduced while increasing the flow at one or more of adjacent boreholes, 18, thus allowing the combustion process to proceed more rapidly through the subterranean earth formation in segments contiguous to and intermediate the fracture in registry with the boreholes with the greatest flow.

It will be seen that the present invention provides an improved in situ combustion process for the recovery of hydrocarbons from subterranean earth formations wherein the flow of the combustion products and hydrocarbons released and recoverable from the earth formation is in a manner substantially more efficient than previously obtainable. Further, the induced fracture system provides relatively open communication between the vertical boreholes and the combustion zone as well as the earth formation therebetween for assuring that the products of combustion and the fluids released from earth formations due to the combustion process may be quickly and easily recovered so as not to impede the combustion process.

What is claimed is:

1. An improved method of in situ combustion of carbonaceous material in a subterranean earth formation for effecting the recovery of hydrocarbons, comprising the steps of penetrating the earth formation with a pair of boreholes projecting into the earth formation along a substantially horizontal plane with respect to the earth surface and along a plane substantially perpendicular to the plane of maximum permeability in the earth formation with said boreholes being parallel to and separated from one another along the plane of maximum permeability, penetrating the earth formation with a plurality of vertically extending boreholes with these vertical boreholes being spaced apart from one another along a plane substantially parallel to and intermediate said pair of boreholes, providing an induced fracture in said earth formation at each of the plurality of vertical boreholes along a plane substantially parallel to the plane of maximum permeability and intersecting with each of said pair of boreholes for establishing a plurality of fluid flow paths projecting between said pair of boreholes and said plurality of boreholes, introducing a combustion-supporting medium into said earth formation through at least one of said pair of boreholes, initiating combustion of the carbonaceous material adjacent to at least one of said pair of boreholes to form a combustion zone, withdrawing hydrocarbon-containing fluid resulting from or displaced by said combustion primarily via said fluid flow paths through said plurality of boreholes, and controlling the rate of flow of said fluid through each of said plurality of boreholes for selectively controlling the configuration and rate of propagation of said combustion zone.

2. An improved method of in situ combustion as claimed in claim 1, wherein the combustion of the carbonaceous material is initiated at each of said pair of boreholes projecting into the earth formation along a substantially horizontal plane.

3. An improved method of in situ combustion as claimed in claim 1, wherein said earth formation is petroleum-bearing sand or shale.

4. An improved method of in situ combustion as claimed in claim 1, wherein the earth formation is a coal bed.

* * * * *